US009935392B2

(12) United States Patent
Ito et al.

(10) Patent No.: US 9,935,392 B2
(45) Date of Patent: Apr. 3, 2018

(54) ELECTRIC WIRE AND TERMINAL CONNECTING CONSTRUCTION AND FABRICATION METHOD THEREOF

(75) Inventors: Naoki Ito, Shizuoka (JP); Yasunori Nabeta, Shizuoka (JP)

(73) Assignee: YAZAKE CORPORATION, Tokyo (JP)

( * ) Notice: Subject to any disclaimer, the term of this patent is extended or adjusted under 35 U.S.C. 154(b) by 472 days.

(21) Appl. No.: 13/978,055

(22) PCT Filed: Feb. 3, 2012

(86) PCT No.: PCT/JP2012/053030
§ 371 (c)(1),
(2), (4) Date: Jul. 2, 2013

(87) PCT Pub. No.: WO2012/105722
PCT Pub. Date: Aug. 9, 2012

(65) Prior Publication Data

US 2013/0303019 A1 Nov. 14, 2013

(30) Foreign Application Priority Data

Feb. 4, 2011 (JP) ..... 2011-022598

(51) Int. Cl.
*H01R 13/52* (2006.01)
*H01R 13/533* (2006.01)
(Continued)

(52) U.S. Cl.
CPC ..... *H01R 13/5205* (2013.01); *H01R 13/5216* (2013.01); *H01R 13/533* (2013.01);
(Continued)

(58) Field of Classification Search
CPC ..... H01R 13/52; H01R 13/5205; H01R 13/5216; H01R 13/5221; H01R 13/533; H01R 4/18; H01R 4/70; H01R 43/24
(Continued)

(56) References Cited

U.S. PATENT DOCUMENTS 3,757,031 A * 9/1973 Izraeli ..... H02G 15/113 138/155
4,863,535 A 9/1989 More
(Continued)

FOREIGN PATENT DOCUMENTS

CN 101488617 A 7/2009
CN 101601173 A 12/2009
(Continued)

OTHER PUBLICATIONS

Korean Office Action for the related Korean Patent Application No. 10-2013-7020076 dated Jun. 25, 2014.
(Continued)

*Primary Examiner* — Tulsidas C Patel
*Assistant Examiner* — Travis Chambers
(74) *Attorney, Agent, or Firm* — Kenealy Vaidya LLP

(57) ABSTRACT

An electric wire and terminal connecting construction has an electric wire having an insulation covering portion where a conductor portion is covered with an insulation material and a conductor exposed portion where the insulation material on an end portion of the electric wire is removed, a terminal including a crimping portion crimped to the conductor exposed portion to thereby be connected to the electric wire, and a seal portion covering the conductor exposed portion exposed from the terminal, wherein the seal portion has an external resin portion forming an outer surface side of the seal portion and made from a thermoplastic resin and an internal resin portion made from a thermoplastic resin of
(Continued)

which a fusing point is lower than that of the external resin portion and forming an inner surface side of the seal portion, and is divided so as to be attached to the conductor exposed portion.

6 Claims, 9 Drawing Sheets

(51) Int. Cl.
*H01R 4/18* (2006.01)
*H01R 4/70* (2006.01)
*H01R 43/24* (2006.01)

(52) U.S. Cl.
CPC ..... *H01R 4/18* (2013.01); *H01R 4/70* (2013.01); *H01R 43/24* (2013.01)

(58) Field of Classification Search
USPC ..... 439/521, 271, 272, 276, 519, 604, 606, 439/901, 936
See application file for complete search history.

(56) References Cited

U.S. PATENT DOCUMENTS 4,963,700 A 10/1990 Olsen et al.
5,021,611 A * 6/1991 Amano ..... H01R 4/70 156/49
5,326,273 A * 7/1994 Kamon ..... H01R 4/62 174/94 R
5,594,210 A 1/1997 Yabe
5,791,936 A * 8/1998 Nicholson ..... H01R 13/5213 439/521
5,984,724 A * 11/1999 McNeel ..... H01R 13/405 439/281
6,910,925 B2 * 6/2005 Endo ..... H01R 13/187 439/856
7,241,184 B2 * 7/2007 Kuo ..... H01R 13/516 439/604
8,177,591 B2 * 5/2012 Okamura ..... H01R 4/188 439/877
2002/0127915 A1 * 9/2002 Kondo ..... B29C 45/14426 439/606
2004/0121638 A1 6/2004 Kobayashi
2009/0186524 A1 * 7/2009 Maesoba ..... H01R 13/4223 439/595
2010/0075535 A1 3/2010 Mizutani et al.
2011/0070770 A1 * 3/2011 Sakai ..... H01R 4/70 439/521
2011/0275232 A1 * 11/2011 Duesterhoeft ..... H02S 40/34 439/276
2011/0300731 A1 12/2011 Nakamura
2014/0194003 A1 * 7/2014 Nabeta ..... H01R 4/185 439/604

FOREIGN PATENT DOCUMENTS

JP 2003-70144 A 3/2003
JP 2007-250333 A 9/2007
JP 2009-87854 A 4/2009
JP 2010-55930 A 3/2010
JP 2010-108829 A 5/2010
WO 2010/095697 A1 8/2010
WO 2010/139886 A1 12/2010

OTHER PUBLICATIONS

Chinese Office Action for the related Chinese Patent Application No. 201280007754.9 dated Mar. 4, 2016.
Chinese Office Action for the related Chinese Patent Application No. 201280007754.9 dated Jan. 30, 2015.
International Search Report and Written Opinion of the International Search Report for PCT/JP2012/053030 dated Apr. 19, 2012.
Japanese Office Action for the related Japanese Patent Application No. 2011-022598 dated Oct. 7, 2014.

* cited by examiner

ELECTRIC WIRE AND TERMINAL CONNECTING CONSTRUCTION AND FABRICATION METHOD THEREOF

This application is a U.S. national phase filing under 35 U.S.C. § 371 of PCT Application No. PCT/JP2012/053030, filed Feb. 3, 2012, and which in turn claims priority under 35 U.S.C. § 119 to Japanese Patent Application No. JP2011-022598, filed Feb. 4 2011, the entireties of which are incorporated by reference herein.

TECHNICAL FIELD

The present invention relates to an electric wire and terminal connecting construction and a fabrication method thereof.

BACKGROUND ART

Conventionally, a signal line or a power line in which an electric wire having a core made of a copper material and a terminal made of a copper material are connected together is used in a motor vehicle or a household appliance.

On the other hand, in the automotive industry, it is getting crucial to improve fuel consumption of vehicles by reducing vehicle weight in consideration of the environment. Because of this, the industry pays attention to electric wires in which aluminum which is lighter than copper is used as a material for a core.

However, aluminum corrodes easily in the presence of water and copper ion, and this causes a problem that a core made of aluminum corrodes easily when water infiltrates into a connecting portion where the aluminum core is connected with a copper terminal.

Then, electric wire and terminal connecting constructions have been proposed in which a connecting portion between an aluminum core of an electric wire and a copper terminal is covered by a resin for waterproofing so as to prevent the corrosion of the aluminum core (for example, refer to PTL 1).

CITATION LIST

Patent Literature

[PTL 1] JP-A-2010-108829

SUMMARY OF INVENTION

Technical Problem

An electric wire and terminal connecting construction described in PTL 1 includes a conductor portion which is exposed from a terminal and a resin layer which is coated so as to cover at least part of the terminal to seal it off.

However, it is difficult to control the shape of the resin layer which is coated, and hence, external shapes of resin layers vary one by one. Thus, when a terminal which is connected with an electric wire using such an electric wire and terminal connecting construction is inserted into an insertion port of a connector housing, there is caused a problem that the resin tends to easily interfere with the insertion port.

Although it is considered as a solution to the problem to make uniform external shapes of resin layers by adopting an injection resin molding approach which employs a mold, an injection molding machine and a mold are needed for each fabrication site, which increases the equipment costs. As a result, there is caused a different problem that the fabrication costs are increased.

As a solution to the problem that the equipment costs are increased, it is considered to provide an exclusive injection resin molding operation site to perform the injection resin molding work at this operation site collectively. However, transportation costs are increased which are incurred in transporting electric wires so processed between working stations involved in the fabrication process of the electric wire and terminal connecting construction. Therefore, the problem that the fabrication costs are increased remains unsolved.

The present invention has been made in view of these situations, and an object of the present invention is to provide an electric wire and terminal connecting construction which can increase an outside dimension accuracy of a seal portion while suppressing the fabrication costs and a fabrication method thereof.

Solution to Problem

In order to attain the object, according to a first aspect of the present invention, there is provided an electric wire and terminal connecting construction, comprising an electric wire having an insulation covering portion where a conductor portion is covered with an insulation material, and a conductor exposed portion where the insulation material on an end portion of the electric wire is removed, and a terminal including a crimping portion which is crimped to the conductor exposed portion to thereby be connected to the electric wire, and a seal portion which covers the conductor exposed portion which is exposed from the terminal, wherein the seal portion has an external resin portion which forms an outer surface side of the seal portion and which is made from a thermoplastic resin, and an internal resin portion which is made from a thermoplastic resin of which a fusing point is lower than that of the external resin portion and which forms an inner surface side of the seal portion, and the seal portion is divided so as to be attached to the conductor exposed portion.

According to a second aspect of the present invention, there is provided an electric wire and terminal connecting portion as set forth in the first aspect, wherein the seal portion is divided into two portions.

According to a third aspect of the present invention, there is provided an electric wire and terminal connecting portion as set forth in the first or second aspect, wherein the seal portion is formed so that the external resin portion covers a parting line of the internal resin portion from which the internal resin portion is parted.

In order to achieve the object, according to a fourth aspect of the present invention, there is provided a method of fabrication of an electric wire and terminal connecting construction having an electric wire having an insulation covering portion where a conductor portion is covered with an insulation material and a conductor exposed portion where the insulation material on an end portion of the electric wire is removed, a terminal including a crimping portion which is crimped to the conductor exposed portion to thereby be connected to the electric wire, and a seal portion which covers the conductor exposed portion which is exposed from the terminal, the method of fabrication including a seal portion forming step of forming the seal portion in which an outer surface side of the seal portion is formed of an external resin portion which is made from a thermoplastic resin and an inner surface side of the seal portion is formed of an internal resin portion which is made from a thermoplastic resin of which a fusing point is lower than that of the external resin portion and which is divided so as to be attached to the conductor exposed portion and a seal portion bonding step of bonding the conductor exposed portion and the seal portion together by applying heat of which a temperature is higher than the fusing point of the internal resin portion and is lower than the fusing point of the external resin portion to the seal portion when the seal portion is attached to the conductor exposed portion.

Advantageous Effects of Invention

In the electric wire and terminal connecting construction according to the first aspect of the present invention, the seal portion has the external resin portion which forms the outer surface side of the seal portion and which is made from the thermoplastic resin and the internal resin portion which is made from the thermoplastic resin of which the fusing point is lower than that of the external resin portion and which forms the inner surface side of the seal portion and is divided so as to be attached to the conductor exposed portion. Therefore, the seal portion can be attached to the conductor exposed portion only by assembling together divided pieces of the seal portion and applying pressure and heat to the seal portion. This enables the electric wire and terminal connecting construction to be fabricated at a predetermined fabrication site collectively. Moreover, by heating the seal portion with the heat of which the temperature is higher than the fusing point of the internal resin portion and is lower than the fusing point of the external resin portion, the external shape of the external resin portion can be maintained even after the heat has been applied to the seal portion. Thus, the external dimension accuracy of the seal portion can be enhanced while suppressing the fabrication costs.

In the electric wire and terminal connecting construction according to the second aspect of the present invention, the seal portion is divided into two which is the least number in which the seal portion can be divided, and therefore, the assemblage can be facilitated.

In the electric wire and terminal connecting construction according to the third aspect of the present invention, the seal portion is formed so that the external resin portion covers the parting line of the internal resin portion which results when the internal resin portion is parted. Therefore, even in the event that the internal resin portion is fused, the overflow of the fused resin to an outer surface of the external resin portion can be prevented effectively.

In the method of fabrication of the electric wire and terminal connecting portion according to the fourth aspect of the present invention, the seal portion is formed in which the outer surface side of the seal portion is formed of the external resin portion which is made from the thermoplastic resin and the inner surface side of the seal portion is formed of the internal resin portion which is made from the thermoplastic resin of which the fusing point is lower than that of the external resin portion and which is divided so as to be attached to the conductor exposed portion, and when the seal portion is attached to the conductor exposed portion, the seal portion can be attached to the conductor exposed portion only by applying heat of which the temperature is higher than the fusing point of the internal resin portion and is lower than the fusing point of the external resin portion to the seal portion. Therefore, the seal portion can be attached to the conductor exposed portion only by assembling together divided pieces of the seal portion and applying pressure and heat to the seal portion. This enables the electric wire and terminal connecting construction to be fabricated at a predetermined fabrication site collectively. Moreover, by heating the seal portion with the heat of which the temperature is higher than the fusing point of the internal resin portion and is lower than the fusing point of the external resin portion, the external shape of the external resin portion can be maintained even after the heat has been applied to the seal portion. Thus, the external dimension accuracy of the seal portion can be enhanced while suppressing the fabrication costs.

DESCRIPTION OF EMBODIMENTS

Figure 1:
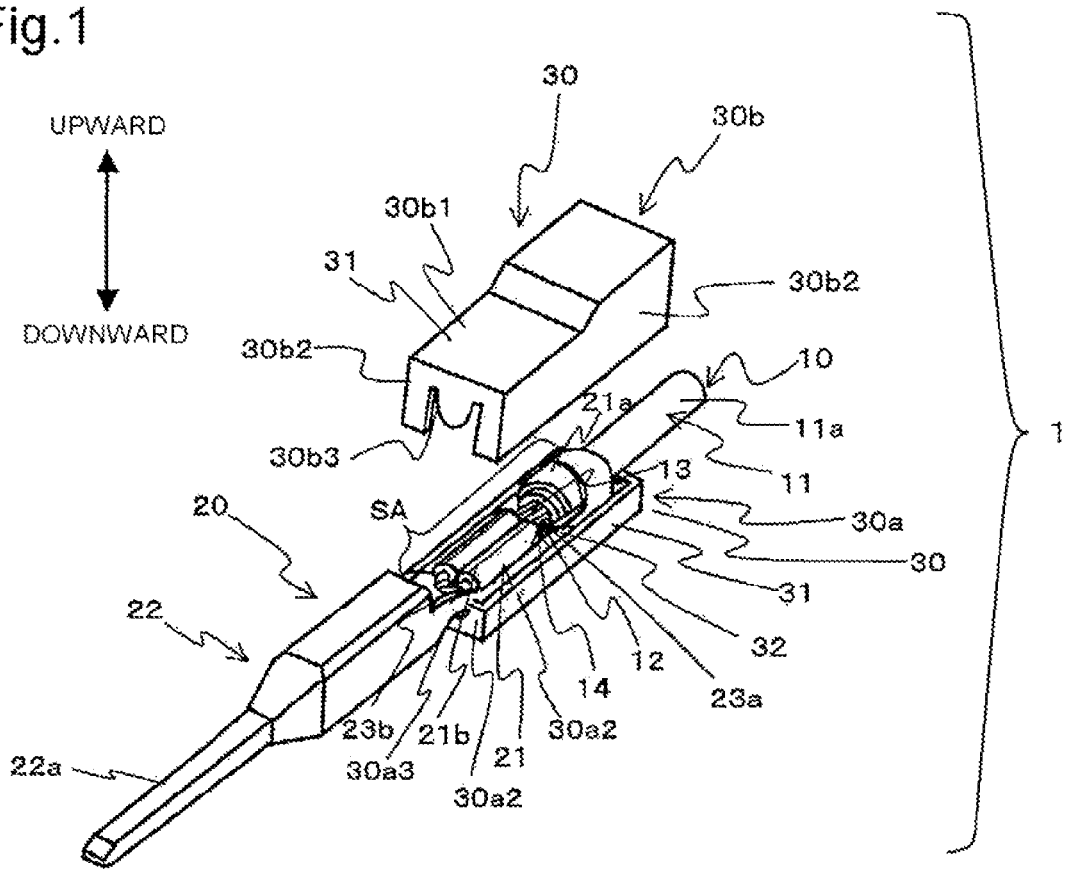
FIG. 1 is an exploded perspective view of an electric wire and terminal connecting construction according to an embodiment of the present invention.

Hereinafter, referring to the drawings, preferred embodiments of an electric wire and terminal connecting construction and a fabrication method thereof according to the present invention will be described in detail.

Embodiment

Figure 2:
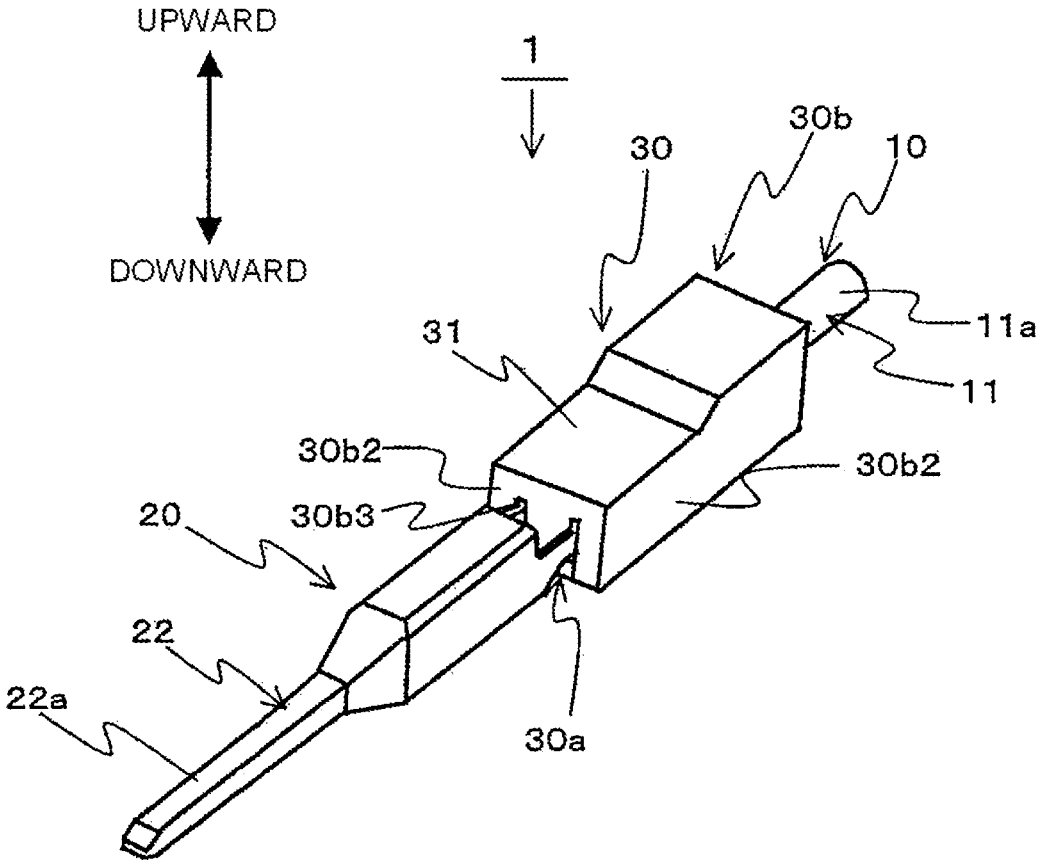
FIG. 2 is a perspective view of the electric wire and terminal connecting portion according to the embodiment of the present invention.
Figure 3:
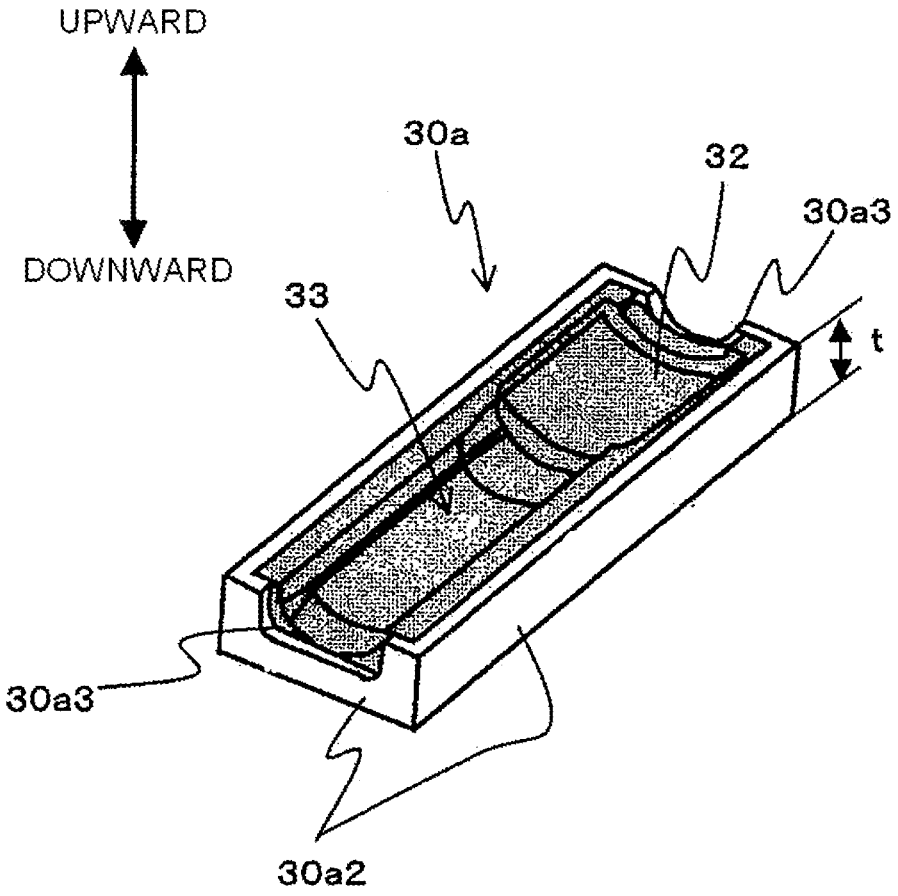
FIG. 3 is an enlarged perspective view of a first divided portion shown in FIG. 1 which results when it is seen from thereabove.
Figure 4:
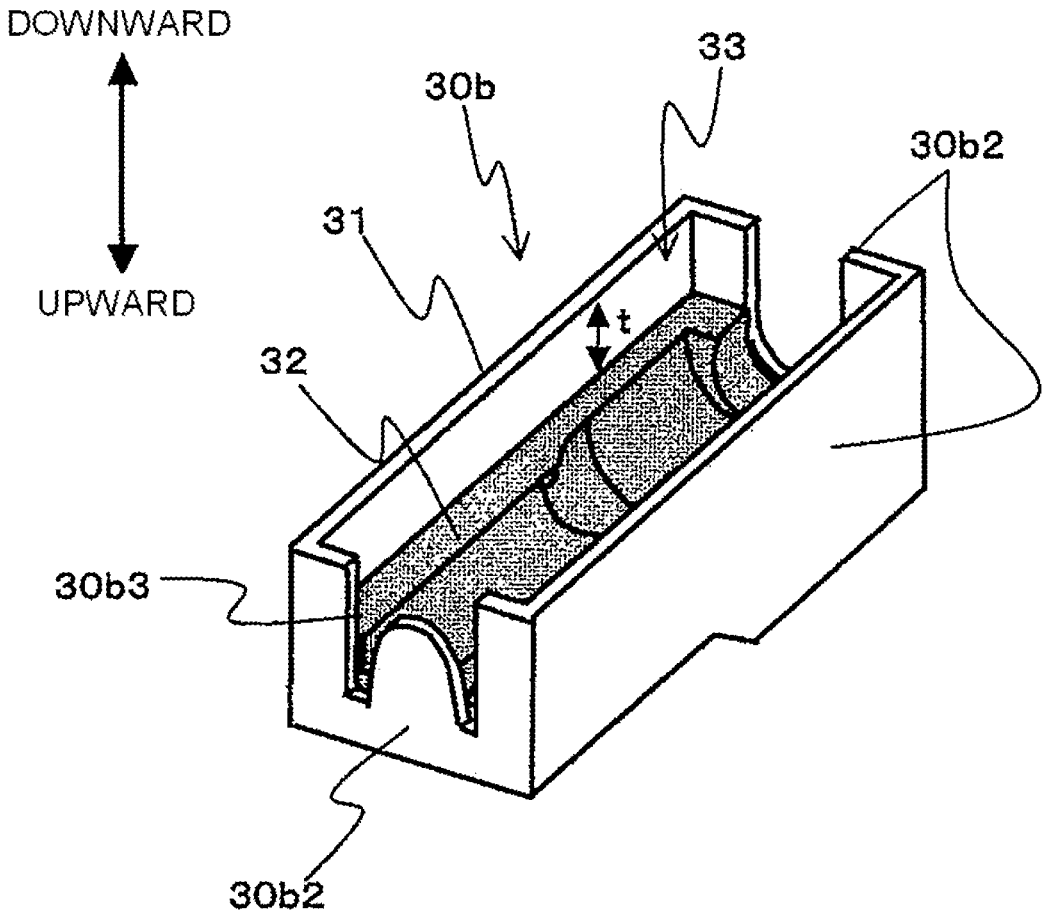
FIG. 4 is an enlarged perspective view of a second divided portion shown in FIG. 1 which results when it is seen from therebelow.
Figure 5:
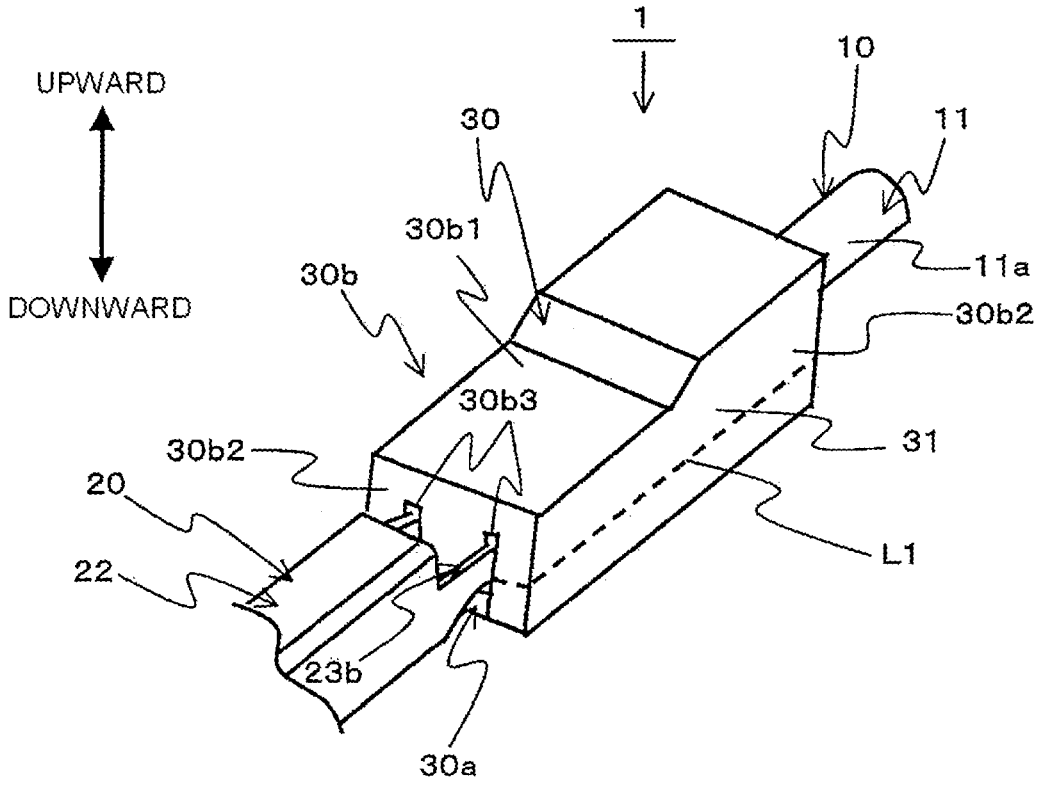
FIG. 5 is an enlarged view of a main part of the electric wire and terminal connecting portion shown in FIG. 1.

FIG. 1 is an exploded perspective view of an electric wire and terminal connecting construction 1 according to an embodiment of the present invention. FIG. 2 is a perspective view of the electric wire and terminal connecting portion according to the embodiment of the present invention. FIG. 3 is an enlarged perspective view of a first divided portion 30*a* shown in FIG. 1 which results when it is seen from thereabove. FIG. 4 is an enlarged perspective view of a second divided portion 30*b* shown in FIG. 1 which results when it is seen from therebelow. FIG. 5 is an enlarged view of a main part of the electric wire and terminal connecting portion 1 shown in FIG. 1. For the sake of convenience, in the drawings, directions indicated by arrows are referred to as upward and downward directions.

An electric wire and terminal construction 1 has an electric wire 10, a terminal 20 and a seal portion 30.

Firstly, the electric wire 10 will be described. As FIG. 1 show, the electric wire 10 has an insulation covering portion 11 and a conductor exposed portion 12.

The insulation covering portion 11 is a portion where a conductor portion 14 which is made up of a bundle of cores 13 made of a conductor such as an aluminum material is covered with an insulation portion 11*a* which is made from an insulation material such as polypropylene. The material of the insulation portion 11*a* is not limited to polypropylene, and hence, there will be no problem in using other insulation materials.

The conductor exposed portion 12 is a portion where a portion of the insulation portion 11*a* which is situated on an end portion of the electric wire 10 is removed so that the conductor portion 14 is exposed.

Next, the terminal 20 will be described. The terminal 20 has an electric wire connecting portion 21, a mating terminal connecting portion 22 and a cutout portion 23.

The electric wire connecting portion 21 is a portion where the electric wire 10 is connected. This electric wire connecting portion 21 is made up of a copper conductor and has a U-shape or V-shape.

In addition, the electric wire connecting portion 21 has an insulation barrel 21*a* and a wire barrel 21*b*.

The insulation barrel 21*a* is a crimping portion which is crimped to the insulation covering portion 11 of the electric wire 10 by a crimper and an anvil.

The wire barrel 21*b* is a crimping portion which is crimped to the conductor portion 14 which is exposed by removing the insulation portion 11*a* of the electric wire 10 by a crimper and an anvil.

The mating terminal connecting portion 22 has a rod-shaped portion 22*a* which is provided integrally with the electric wire connecting portion 21. This rod-shaped portion 22*a* is electrically connected to a female terminal of a mating connector which is a target component to which the rod-shaped portion is to be connected. Namely, the mating terminal connecting portion 22 is a male terminal. Note that this mating terminal connecting portion 22 is not limited to a male terminal but may be a female terminal.

The cutout portion 23 has a box shape in which a cutout is formed in an upper portion thereof. This cutout portion 23 has a first cutout portion 23*a* and a second cutout portion 23*b*. The first cutout portion 23*a* is a cutout portion which is formed between the insulation barrel 21*a* and the wire barrel 21*b*. The second cutout portion 23*b* is a cutout portion which is formed between the wire barrel 21*b* and the mating terminal connecting portion 22.

Next, the seal portion 30 will be described. The seal portion 30 has a function to cover a seal requiring portion (hereinafter, referred to as a sealed area SA) to waterproof the portion so as to prevent the corrosion thereof.

Here, the sealed area SA includes along the direction in which the electric wire 10 extends a range defined by the insulation barrel 21*a*, a range including a portion of the insulation portion 11 which extends from the insulation barrel 21*a* in an opposite direction to the end portion of the electric wire 10, a range defined by the wire barrel 21*b*, a range defined by the first cutout portion 23*a* and part of a range defined by the second cutout portion 23*b*.

In addition, the seal portion 30 has external resin portions 31 and internal resin portions 32. The external resin portions 31 are portions which form an outer surface side of the seal portion 30. This external resin portion 31 is formed from a thermoplastic resin, and for example, polyethylene terephthalate is used.

The internal resin portions 32 are portions which form an inner surface side of the seal portion 30. This internal resin portion 32 is formed from a thermoplastic resin of which a fusing point is lower than that of the resin which forms the external resin portion 31. When a polyethylene terephthalate of which a fusing point is two hundred and several tens ° C. is used for the external resin portion 31, a polyethylene terephthalate of which a fusing point is a hundred and several tens ° C. is used for the internal resin portion 32.

The seal portion 30 is divided into two portions; a first divided portion 30*a* which makes up a lower portion of the seal portion 30 and a second divided portion 30*b* which makes up an upper portion of the seal portion.

As FIG. 3 shows, the first divided portion 30*a* has substantially a box shape which is opened on an upper side and which has a bottom wall 30*a*1 and side walls 30*a*2. In the first divided portion 30*a*, a cutout 30*a*3 is formed in each of the side walls 30*a*2 which face each other in the direction in which the electric wire 10 extends.

As FIG. 4 shows, the second divided portion 30*b* has substantially a box shape which is opened on a bottom side and which has an upper wall 30*b*1 and side walls 30*b*2. In the second divided portion 30*b*, a cutout 30*b*3 is formed in each of the side walls 30*b*2 which face each other in the direction in which the electric wire 10 extends.

By assembling the first divided portion 30*a* and the second divided portion 30*b* together, a sealed area accommodating portion 33 is defined inside the first divided portion 30*a* and the second divided portion 30*b* assembled together. This sealed area accommodating portion 33 has a shape which enables the sealed area accommodating portion 33 to be brought into close contact with the sealed area SA. More specifically speaking, the internal resin portion 32 is formed so as to match the shape of the sealed area SA so that the seal portion 30 and the sealed area SA are closely secured to each other without any gap defined therebetween.

When assembled to the first divided portion 30*a*, the second divided portion 30*b* is configured so that the side walls 30*b* cover the side walls 30*a*2 of the first divided portion 30*a*. Namely, the external resin portion 31 which forms the side walls 30*b*2 of the second divided portion 30*b* covers an outer surface of the external resin portion 31 which forms the side walls 30*a*2 of the first divided portion 30*a*. In addition, a lower end of the internal resin portion 32 of the second divided portion 30*b* is formed so as to be situated in a position which is spaced a distance equal to a thickness "t" of the first divided portion 31 apart from a lower end of the external resin portion 31.

Because of this, when the first divided portion 30*a* and the second divided portion 30*b* are assembled together, as FIG. 5 shows, the external resin portion 31 of the second divided portion 30*b* covers a parting line L1 between the internal resin portions 32 of the first divided portion 30*a* and the second divided portion 30*b*.

Because of this, the sealed area SA is set in the sealed area accommodating portion 33 in the first divided portion 30*a*, and thereafter, the first divided portion 30*a* and the second divided portion 30*b* are assembled together, whereby the seal portion 30 covers the sealed area SA.

The seal portion 30 is bonded to the sealed area SA by applying pressure and heat to the seal portion 30. Here, a temperature at which the seal portion 30 is heated is set to a temperature which is higher than a fusing point of the internal resin portion 32 and is lower than a fusing point of the external resin portion 31. When the internal resin portions 32 are fused at such a temperature and are thereafter cooled to set, the seal portion 30 is bonded to the sealed area SA via the internal resin portions 32. Namely, the internal resin portions 32 function as a thermoplastic adhesive.

As this occurs, since the external resin portions 31 are not fused, the external shape of the seal portion 30 remains unchanged. A thickness of the internal resin portion 32 is set so that the seal portion 30 and the sealed area SA are bonded together without any gap defined therebetween via the internal resin portions 32 functioning as a bonding layer. Because of this, there occurs no such situation that the internal resin portions 32 are fused so as to overflow to an outer surface of the external resin portions 31. The internal resin portions 32 are each set to dimensions which take into consideration an amount by which the internal resin portions 32 are filled in space in the sealed area SA.

Figure 6A:
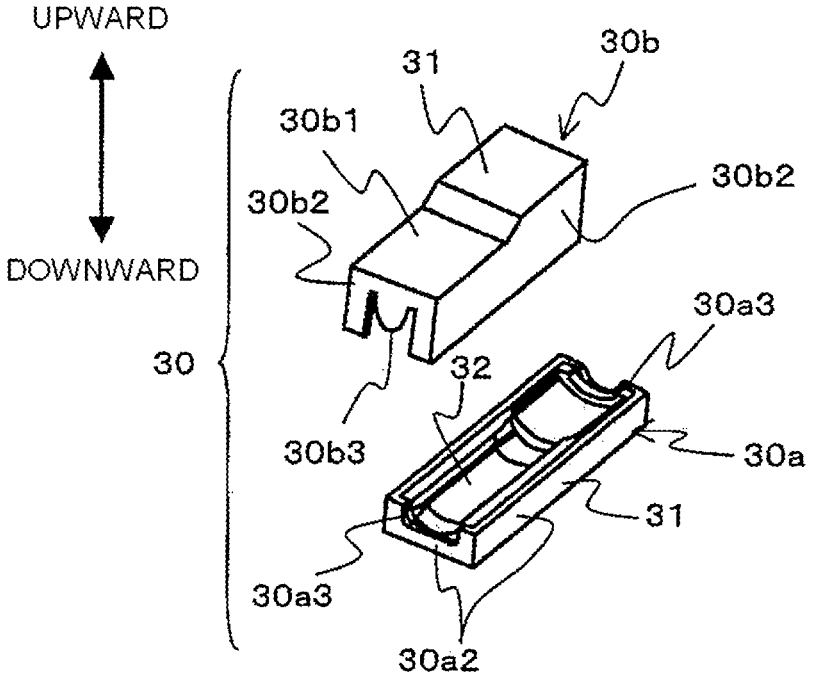
FIGS. 6 (*a*) and (*b*) show drawings depicting fabrication steps of the electric wire and terminal connecting portion according to the embodiment.
Figure 6B:
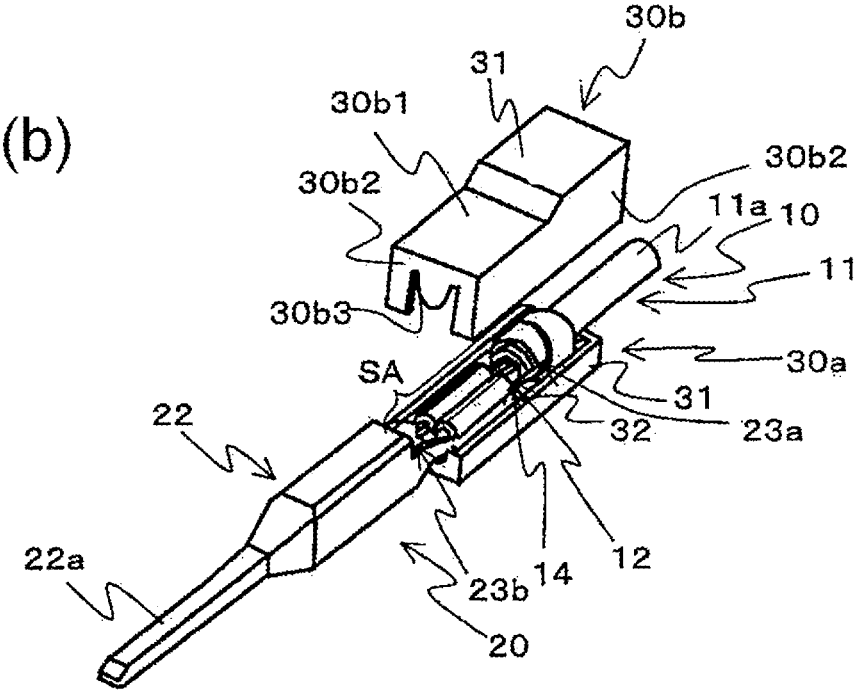

Next, referring to FIGS. 6 (*a*) and (*b*) and FIGS. 7 (*a*) and (*b*), fabrication steps of the electric wire and terminal connecting construction 1 according to the embodiment of the present invention will be described. FIGS. 6 (*a*) and (*b*) and FIGS. 7 (*a*) and (*b*) show drawings depicting fabrication steps of the electric wire and terminal connecting construction 1 of the embodiment.

Firstly, a person working at a fabrication site fabricates a seal portion 30 (refer to FIG. 6(*a*)). This seal portion 30 is designed to be divided into a first divided portion 30*a* and a second divided portion 30*b*. When fabricating such a seal portion 30, external resin portions 31 and internal resin portions 32 which correspond respectively to the first divided portion 30*a* and the second divided portion 30*b* are fabricated, and the internal resin portions 32 are attached individually to the corresponding external resin portions 31. In this case, it may be better to provide locking constructions, not shown, on the external resin portions 31 and the internal resin portions 32 so that the external resin portions 31 and the internal resin portions 32 are locked together in the first divided portion 30*a* and the second divided portion 30*b*, respectively.

The configuration of the seal portion 30 is not limited to the configuration in which the internal resin portions 32 are attached to the corresponding external resin portions 31 by providing the locking constructions thereon. For example, a fabrication process may be adopted in which an external resin portion 31 is molded by a mold, and thereafter, another mold is assembled to the external resin portion 31 so molded so as to form a cavity to form an internal resin portion 32, whereby an internal resin portion 32 is formed in the external resin portion 31. Namely, the internal resin portion 32 may be formed in the external resin portion 31 by making use of the bonding function of thermoplastic resin used.

In the seal portion 30 which is fabricated in the way described above, the seal portion 30 can be attached to the sealed area SA only by applying pressure and heat to the first divided portion 30*a* and the second divided portion 30*b* which are now assembled together. Seal portions 30 like this are fabricated by the predetermined fabrication site collectively and are then transported to fabrication sites where electric wires 10 and terminals 20 are connected together. In this case, the injection molding machine and the molds do not have to be provided at the fabrication sites where electric wires 10 and terminals 20 are connected together but may be provided only at the fabrication site of seal portions 30. Thus, the increase in equipment costs can be suppressed. In addition, transporting seal portions 30 including those to be stocked to the fabrication sites in advance can suppress the transportation costs involved in transporting seal portions 30 to the other fabrication sites.

Thereafter, the seal portion 30 is assembled to the sealed area SA (refer to FIG. 6(*b*)). In this assembling work, the sealed area SA is set in the sealed area accommodating portion 33 in the first divided portion 30*a*, and thereafter, the second divided portion 30*b* is assembled on to an upper portion of the first divided portion 30*a*, whereby the sealed area SA is covered by the seal portion 30.

Figure 7A:
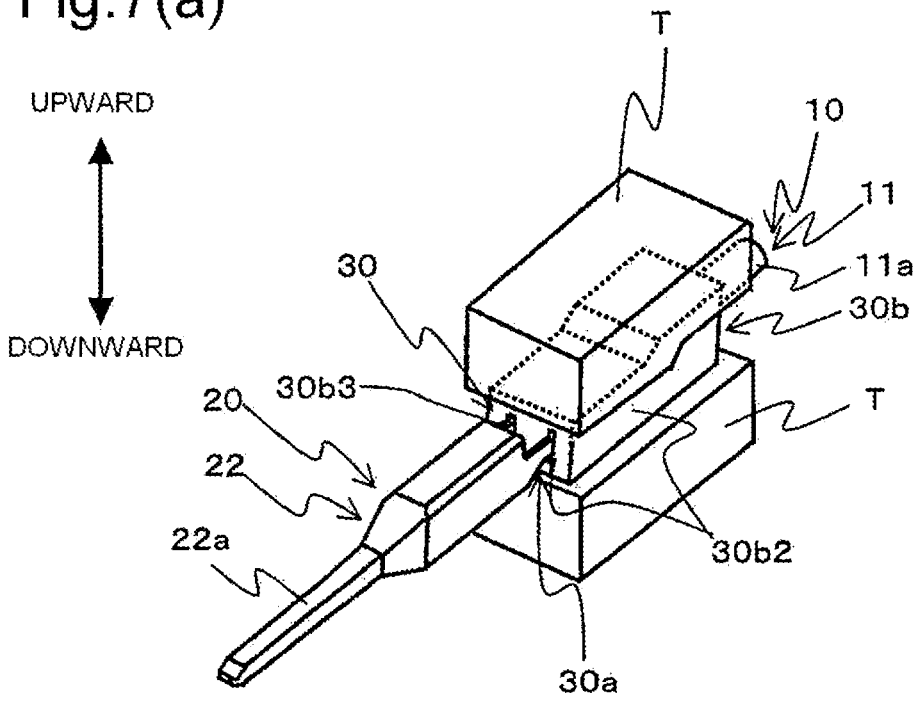
FIGS. 7 (*a*) and (*b*) show drawings depicting fabrication steps of the electric wire and terminal connecting construction according to the embodiment.
Figure 7B:
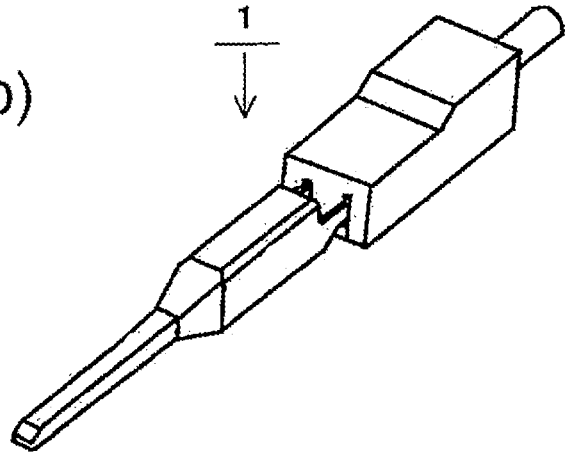

Thereafter, pressure and heat are applied to the seal portion 30 (refer to FIG. 7(*a*)). In this pressure and heat application step, the seal portion 30 is held vertically by flat plate-shaped jigs T having heat conductivity so as to apply a pressure to the seal portion and is heated via the jigs T.

These jigs T are controlled with respect to temperature by a temperature controlling device such as a heater, not shown. The temperature of the jigs T is set by a temperature control device, not shown, to a temperature which is higher than the fusing point of the internal resin portion 32 and is lower than the fusing point of the external resin portion 31. The system which applies pressure and heat to the seal portion 30 is not limited to the one described above and hence other known pressure and heat application systems may be used instead.

When the pressure and heat are applied to the seal portion 30 in the way described above, the internal resin portions 32 are fused between the sealed area SA and the external resin portions 31 and functions as an adhesive with which the external resin portions 31 are bonded to the sealed area SA. In addition, the internal resin portions 32 function as an adhesive with which the first divided portion 30*a* and the second divided portion 30*b* are bonded together. Pressure and heat applying conditions such as a pressure value, a pressurizing speed and a heating speed may be set as required.

Here, the external resin portion 31 of the second divided portion 30*b* is designed to cover the parting line L1 between the internal resin portions 32 of the first divided portion 30*a* and the second divided portion 30*b*. Therefore, even in the event that the internal resin portions 32 are fused, the overflow of the resin from the fused internal resin portions 32 to the outer surface of the external resin portions 31 can be prevented effectively.

Thereafter, the fusion of the whole internal resin portions 32 is waited, and thereafter, the fused internal resin portions 32 are cooled to set. Then, the pressure applied to the seal portion 30 is removed, whereby the electric wire and terminal connecting construction 1 is completed (refer to FIG. 7(*b*)).

In the electric wire and terminal connecting construction 1 according to the embodiment of the present invention, the seal portion 30 has the external resin portions 31 which form the outer surface side of the seal portion 30 and which are made from the thermoplastic resin and the internal resin portions 32 which are made from the thermoplastic resin of which the fusing point is lower than that of the external resin portions 31 and which form the inner surface side of the seal portion 30 and is divided so as to be attached to the conductor exposed portion 12. Therefore, the seal portion 30 can be attached to the sealed area SA only by assembling together the first divided portion 30*a* and the second divided portion 30*b* and applying pressure and heat to the first divided portion 30*a* and the second divided portion 30*b* assembled together. This enables the electric wire and terminal connecting construction 1 to be fabricated at a predetermined fabrication site collectively. Moreover, by heating the seal portion 30 with the heat of which the temperature is higher than the fusing point of the internal resin portions 32 and is lower than the fusing point of the external resin portions 31, the external shapes of the external resin portions can be maintained unchanged even after the heat has been applied to the seal portion 30. Thus, the external dimension accuracy of the seal portion 30 can be enhanced while suppressing the fabrication costs.

In the electric wire and terminal connecting construction 1 according to the embodiment of the present invention, the external resin portions 31 function to protect the internal resin portions 32, and therefore, the sealing function can be enhanced.

In the electric wire and terminal connecting construction 1 according to the embodiment of the present invention, the seal portion 30 is divided into two which is the least number in which the seal portion 30 can be divided, and therefore, the assemblage can be facilitated.

In the electric wire and terminal connecting construction 1 according to the embodiment of the present invention, the seal portion 30 is formed so that the external resin portion 31 of the second divided portion 30*b* is designed to cover the parting line L1 between the internal resin portions 32 of the first divided portion 30*a* and the second divided portion 30*b*. Therefore, even in the event that the internal resin portions 32 are fused, the overflow of the fused resin to the outer surface of the external resin portions can be prevented effectively.

In the method of fabrication of the electric wire and terminal connecting portion 1 according to the embodiment of the present invention, the seal portion 30 is formed in which the outer surface side of the seal portion 30 is formed of the external resin portions 31 which are made from the thermoplastic resin and the inner surface side of the seal portion 30 is formed of the internal resin portions 32 which are made from the thermoplastic resin of which the fusing point is lower than that of the external resin portions and which is divided so as to be attached to the sealed area SA. In addition, when the seal portion 30 is attached to the sealed area SA, the sealed area SA and the seal portion 30 can be bonded together by applying heat of which the temperature is higher than the fusing point of the internal resin portions 32 and is lower than the fusing point of the external resin portions 31 to the seal portion 30. Therefore, the seal portion 30 can be attached to the sealed area SA only by assembling together the first divided portion 30*a* and the second divided portion 30*b* and applying pressure and heat to the first divided portion 30*a* and the second divided portion 30*b* assembled together. This enables the electric wire and terminal connecting construction 1 to be fabricated at the predetermined fabrication site collectively. Moreover, by heating the seal portion 30 with the heat of which the temperature is higher than the fusing point of the internal resin portions 32 and is lower than the fusing point of the external resin portions 31, the external shapes of the external resin portions 31 can be maintained unchanged even after the heat has been applied to the seal portion 30. Thus, the external dimension accuracy of the seal portion 30 can be enhanced while suppressing the fabrication costs.

Modified Example

Figure 8:
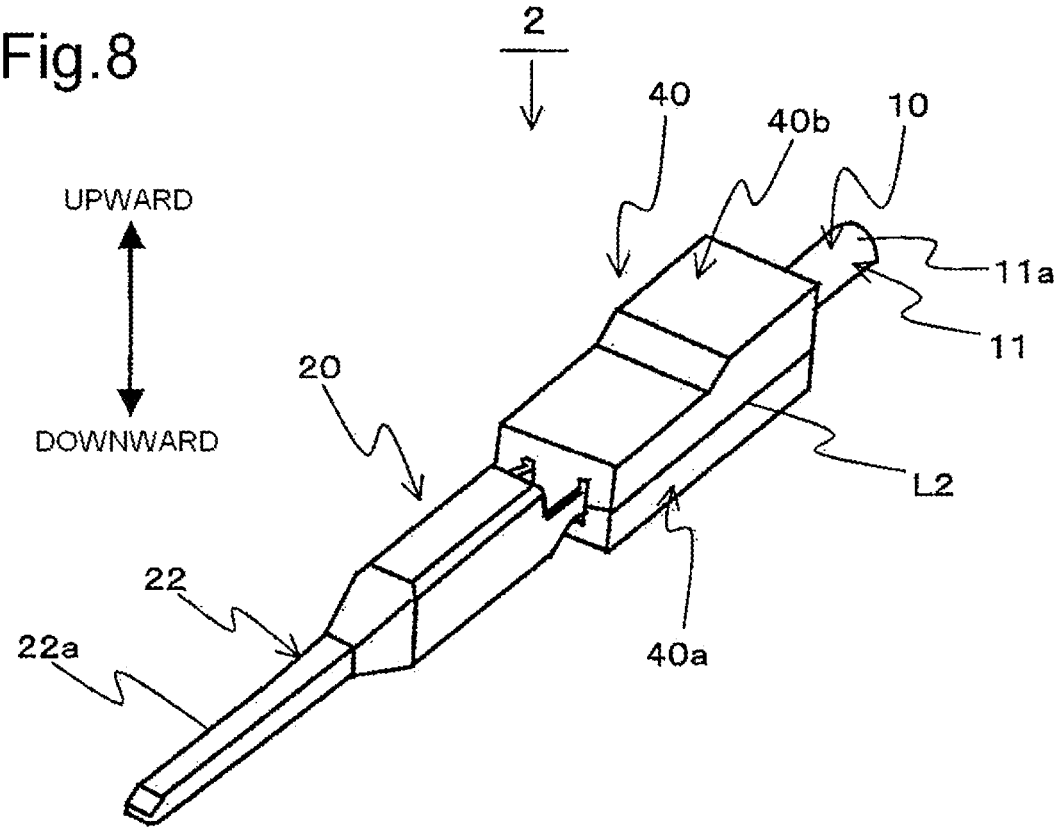
FIG. 8 is a perspective view of an electric wire and terminal connecting construction of a modified example made to the electric wire and terminal connecting construction according to the embodiment.
Figure 9:
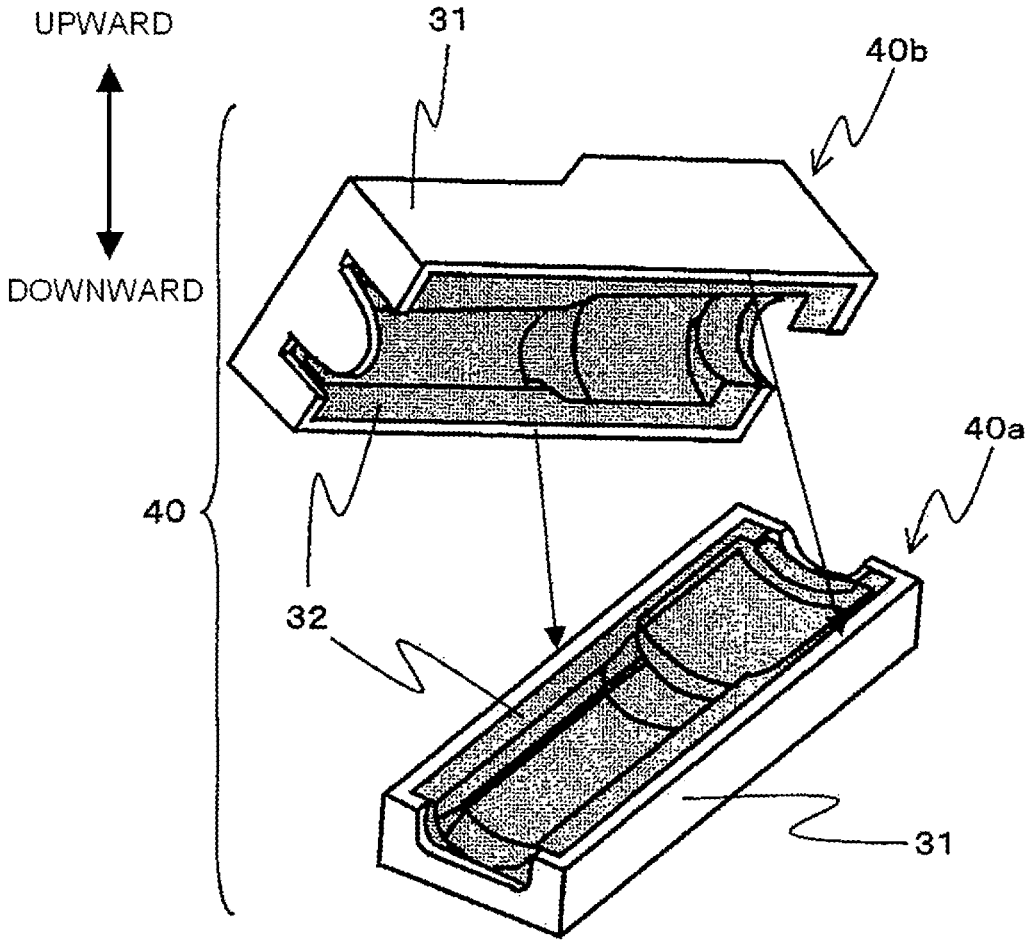
FIG. 9 is an exploded view of a seal portion shown in FIG. 8.

Next, a modified example made to the electric wire and terminal connecting construction 1 according to the embodiment will be described. FIG. 8 is a perspective view of an electric wire and terminal connecting construction 2 of a modified example made to the electric wire and terminal connecting construction 1 according to the embodiment. FIG. 9 is an exploded view of a seal portion 40 shown in FIG. 8.

The electric wire and terminal connecting construction 2 of the modified example has the seal portion 40 in place of the seal portion 30. The other configurations of the electric wire and terminal connecting construction 2 remain the same as those of the embodiment, and like reference numerals will be given to like constituent portions to those of the embodiment.

The seal portion 40 is divided into two portions; a first divided portion 40*a* and a second divided portion 40*b*. The seal portion 40 is built up by combining an upper end face of the first divided portion 40*a* and a lower end face of the second divided portion 40*b* together. Namely, a parting line L2 between external resin portions 31 and a parting line L2 between internal resin portions 32 coincide with each other.

Because of this, although the external resin portion 31 of the second divided portion 40*b* does not cover the parting line L2 between the internal resin portions 32 of the first divided portion 40*a* and the second divided portion 40*b*, the electric wire and terminal connecting construction 2 is similar in configuration to the electric wire and terminal connecting construction 1 in that the external resin portions 31 form an external shape of the seal portion 40.

Consequently, similar to the electric wire and terminal connecting construction 1 of the embodiment, the seal portion 30 can be attached to a sealed area SA only by assembling together the first divided portion 30*a* and the second divided portion 30*b* and applying pressure and heat thereto. This enables the electric wire and terminal connecting construction 2 to be fabricated at a predetermined fabrication site collectively. Moreover, by heating the seal portion 40 with heat of which a temperature is higher than a fusing point of the internal resin portions 32 and is lower than a fusing point of the external resin portions 31, the external shapes of the external resin portions 31 can be maintained unchanged even after the heat has been applied to the seal portion 30. Thus, the external dimension accuracy of the seal portion 30 can be enhanced while suppressing the fabrication costs.

In the electric wire and terminal connecting constructions 1, 2, while the seal portion 30 is described as being formed so as to cover the sealed area SA which includes along the direction in which the electric wire 10 extends the range defined by the insulation barrel 21*a*, the range including the portion of the insulation portion 11 which extends from the insulation barrel 21*a* in the opposite direction to the end portion of the electric wire 10, the range defined by the wire barrel 21*b*, the range defined by the first cutout portion 23*a* and part of the range defined by the second cutout portion 23*b*, the present invention is not limited thereto. Namely, any configuration may be adopted for the electric wire and terminal connecting constructions 1, 2, provided that they are formed so as to cover at least the conductor exposed portion 12.

In addition, in the electric wire and terminal connecting constructions 1, 2, while the seal portion 30 is described as being divided into the two portions; the first divided portion 30*a* and the second divided portion 30*b*, the present invention is not limited thereto. Namely, the seal portion 30 may be divided into two or more portions, provided that the seal portion 30 is divided so as to be attached to the conductor exposed portion 12.

Thus, while the present invention invented by the inventor has been described specifically based on the embodiment of the present invention, the present invention is not limited to the embodiment of the present invention but can be altered variously without departing from the spirit and scope thereof.

This application is based upon and claims the benefit of priority of Japanese Patent Application No. 2011-022598 filed on Feb. 4, 2011, the contents of which are incorporated herein by reference.

INDUSTRIAL APPLICABILITY

In the electric wire and terminal connecting construction according to the present invention, the seal portion has the external resin portion which forms the outer surface side of the seal portion and which is made from the thermoplastic resin and the internal resin portion which is made from the thermoplastic resin of which the fusing point is lower than that of the external resin portion and which forms the inner surface side of the seal portion and is divided so as to be attached to the conductor exposed portion. Therefore, the seal portion can be attached to the conductor exposed portion only by assembling together divided pieces of the seal portion and applying pressure and heat to the seal portion. This enables the electric wire and terminal connecting construction to be fabricated at a predetermined fabrication site collectively. Moreover, by heating the seal portion with the heat of which the temperature is higher than the fusing point of the internal resin portion and is lower than the fusing point of the external resin portion, the external shape of the external resin portion can be maintained even after the heat has been applied to the seal portion. Thus, the external dimension accuracy of the seal portion can be enhanced while suppressing the fabrication costs.

REFERENCE SIGN LIST

1, 2 electric wire and terminal connecting construction;
10 electric wire;
11 insulation covering portion;
11*a* insulation portion;
12 conductor exposed portion;
13 core;
14 conductor portion;
20 terminal;
21 electric wire connecting portion;
21*a* insulation barrel;
21*b* wire barrel;
22 mating terminal connecting portion;
22*a* rod-shaped portion;
23 cutout portion;
23*a* first cutout portion;
23*b* second cutout portion;
30, 40 seal portion;
30*a*, 40*a* first divided portion;
30*a*1 bottom wall;
30*a*2 side wall;
30*a*3 cutout;
30*b*, 40*b* second divided portion;
30*b*1 upper wall;
30*b*2 side wall;
30*b*3 cutout;
31 external resin portion;
32 internal resin portion;
33 sealed area accommodating portion;
SA sealed area;
T jig;
L1, L2 parting line:

The invention claimed is:

1. An electric wire and terminal connecting construction, comprising:

an electric wire having an insulation covering portion where a conductor portion is covered with an insulation material, and a conductor exposed portion where the insulation material on an end portion of the electric wire is removed; and a terminal including a crimping portion which is crimped to the conductor exposed portion to thereby be connected to the electric wire, and a seal portion which covers the conductor exposed portion which is exposed from the terminal;

wherein the seal portion has an external resin portion which forms an outer surface side of the seal portion and which is made from a thermoplastic resin, and an internal resin portion which is made from a thermoplastic resin of which a fusing point is lower than that of the external resin portion and which forms an inner surface side of the seal portion, the seal portion includes a first divided portion and a second divided portion, the first divided portion includes a first wall and a plurality of first side walls extending away from the first wall, the second divided portion includes a second wall and a plurality of second side walls extending away from the second wall, and the first divided portion and the second divided portion are assembled to each other so as to contain the conductor exposed portion, and the external resin portion and the conductor exposed portion are bonded to each other by the fused internal resin portion which is located between the external resin portion and the conductor exposed portion and which is applied with heat.

2. The electric wire and terminal connecting construction as set forth in claim 1, wherein the seal portion is formed so that the external resin portion covers a parting line of the internal resin portion from which the internal resin portion is parted.

3. A method of fabrication of the electric wire and terminal connecting construction according to claim 1, the method of fabrication comprising:

a seal portion forming step of forming the seal portion in which the outer surface side of the seal portion is formed of the external resin portion which is made from thermoplastic resin, and the inner surface side of the seal portion is formed of the internal resin portion which is made from thermoplastic resin of which a fusing point is lower than that of the external resin portion and which is divided so as to be attached to the conductor exposed portion; and a seal portion bonding step of fusing the internal resin portion by applying heat of which a temperature is higher than the fusing point of the internal resin portion and is lower than the fusing point of the external resin portion to the seal portion and then bonding the conductor exposed portion and the seal portion together by the fused internal resin portion when the seal portion is attached to the conductor exposed portion.

4. The electric wire and terminal connecting construction of claim 1, wherein each of the second side walls engages a respective one of the first side walls.

5. The electric wire and terminal connecting construction of claim 1, wherein each of a pair of the first side walls covers a respective one of a pair of the second side walls.

6. The electric wire and terminal connecting construction of claim 1, wherein each of the first side walls abuts a respective one of the second side walls.

* * * * *